US005551605A

United States Patent [19]

Bethlendy

[11] Patent Number: 5,551,605

[45] Date of Patent: Sep. 3, 1996

[54] SEALING AND DISPENSING DEVICE

[75] Inventor: George Bethlendy, Pittsford, N.Y.

[73] Assignee: Berthlex, Inc., Mississauga, Canada

[21] Appl. No.: 327,659

[22] Filed: Oct. 24, 1994

[51] Int. Cl.[6] ..... B65D 83/00

[52] U.S. Cl. ..... 222/402.25; 222/464.4; 222/518

[58] Field of Search ..... 222/464.4, 394, 222/402.1, 402.25, 559, 568, 575, 518; 215/4, 5

[56] References Cited

U.S. PATENT DOCUMENTS

| | | | |
|---|---|---|---|
| 2,326,641 | 8/1943 | Heeter et al. | 222/518 X |
| 2,713,988 | 7/1955 | Kitterman | 222/518 X |
| 5,377,872 | 1/1995 | Manney | 222/518 X |

*Primary Examiner*—Gregory L. Huson

*Attorney, Agent, or Firm*—Cumpston & Shaw

[57] ABSTRACT

The disclosed invention is directed to a sealing and dispensing apparatus that is used to preserve the contents of a carbonated beverage container which contains a threaded adapter which replaces the screw cap of the container. The adapter contains a central opening in the form of an elongated channel which at its top end is connected to a novel valving mechanism which controls the flow of the pressurized liquid from the carbonated beverage container. The opposite or lower end of the central opening is connected to one end of a flexible elongated tube which is sealably connected to the central opening with the robe containing a weight at its free end. A valve assembly containing a novel plunger mechanism in combination with a biasing spring operates to effectively seal the central opening in a closed position to prevent any liquid flow, and when activated by digital pressure, provides a controlled uninterrupted flow of carbonated beverage through a flow path, passed the plunger, and out of a discharge spout.

9 Claims, 4 Drawing Sheets

SEALING AND DISPENSING DEVICE

BACKGROUND OF THE INVENTION

The present invention relates to a liquid sealing and dispensing device and more specifically to a device for the controlled dispensing of a pressurized liquid from a container.

Carbonated beverages are normally dispensed from a bottle or container by hand simply by turning the bottle over and pouring a drink into a container such as a glass. Recently, carbonated beverages are being sold in larger and larger containers which do not always allow for the contents to be used at one sitting. Therefore, in these instances, when the remaining contents of the container are stored over a period of time such as several days or more, the contents in the container tend to become flat because the screw type sealing cap on these containers does not adequately seal the container. In addition, when used from time to time the cap is normally placed on a counter and the contents of the container are opened to the atmosphere which further tends to dissipate the carbonic acid content which is essential in preserving the effervescence or fizz contained within the beverage, resulting in the beverage soon losing its flavor and effervescence.

In response to the above,, the art has developed detachable dispensing heads for carbonated beverage devices which address this particular problem. These devices, such as that illustrated in U.S. Pat. No. 4,995,534, tend to be extremely complex in their design, and have a high head or silhouette which results in the bottle gaining in height and therefore presenting storage problems with regard to the height of storage shelves contained within a refrigerator. The device of the type illustrated by the U.S. Pat. No. 4,995,534 patent is complex in structure and therefore tends to be susceptible to breakage or malfunction when used over a long period of time due to the large number of parts required in its construction. In addition, the complexity of devices of this type also results in increased manufacturing costs and therefore are expensive to purchase.

There is, therefore, a need in the art for a, detachable sealing and dispensing apparatus having particular use for sealing and preserving the flavor and freshness of a carbonated beverage, which is both simple and durable in its construction and which provides for a controlled smooth flow of liquid from the container. There is also a need for a device which provides a low profile which does not significantly increase the overall bottle height when in place. There is also a need in the field for a device which is leak proof and which effectively empties the entire contents of a liquid container no matter what position the container is placed in when being poured or emptied.

It is therefore, an object of the present invention to provide for an improved sealing and dispensing device which overcomes the above noted disadvantages, and which provides for a simple, efficient controlled valving mechanism and which has a low profile for storage advantages.

SUMMARY OF THE INVENTION

The present invention is directed to a sealing and dispensing apparatus and is preferably adapted for a device that is used to preserve the contents of a carbonated beverage container for an indefinitely long period of time. More specifically, the present invention is directed to a device which contains a threaded adapter which replaces the screw cap of a carbonated beverage container. The adapter contains a central opening in the form of an elongated channel which at its top end is connected to a novel valving mechanism which controls the flow of the pressurized liquid from the carbonated beverage contains. The opposite or lower end of the central opening is connected to one end of a flexible elongated tube which is sealably connected to the central opening with the robe containing a weight at its free end. The weighted free end of the robe is contained within the carbonated beverage container and in operation acts to effectively siphon or remove the contents of the beverage container when the valve is in its open position. A valve assembly containing a novel plunger mechanism in combination with a biasing spring operates to effectively seal the central opening in a closed position to prevent any liquid flow, and when activated by digital pressure, provides a controlled uninterrupted flow of carbonated beverage through a flow path, passed the plunger, and out of a discharge spout. The novel structure of the present invention assures that the necessary carbonic acid contained in the carbonated beverage remains undisturbed following each discharge, and allows for the entire contents of a large carbonated beverage container to remain fresh and effervescent to the last serving.

DETAILED DESCRIPTION OF THE INVENTION

Figure 1:
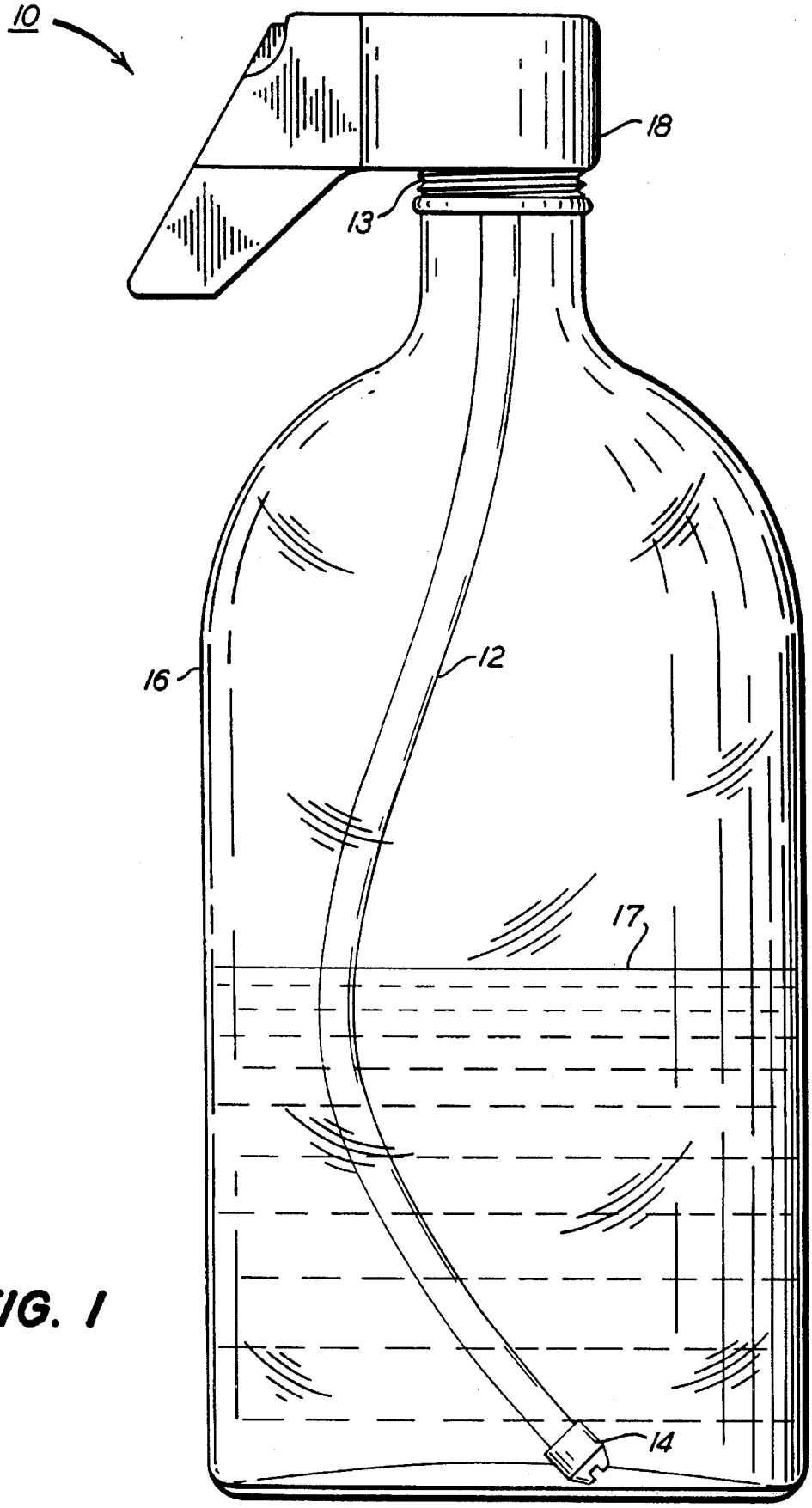
FIG. 1 is a side elevational view embodying the present invention, with the adapter for the sealing and dispensing device being affixed to the threaded top of the bottle with an elongated robe connected at the top of the adapter which projects down into the bottom of the container.

In FIGS. 1–11, like reference numerals represent like parts.

A preferred embodiment of the invention is illustrated in FIG. 1 in which the sealing and dispensing device of the present invention is illustrated. The device includes an adapter 10 having an elongated tube 12 connected thereto with the adapter being sealed in the threaded engagement to the threaded orifice 13 of bottle 16. The tube may be made of any suitable flexible plastic.

The adapter contains conventional internal threads 19, which are designed to mate with the conventional external threads of a typical beverage bottle or the like. The adapter further contains a seal 46 (FIG. 2), which insures a proper sealing engagement of the adapter with the threaded top of the container. The elongated tube further contains a weighted end 14 which will be described in greater detail hereinafter. As shown by the drawing, the flexible tube 12 has a length sufficient to allow it to be used in containers having a wide range in height. With the weighted end, the tube functions to allow a container to be emptied of virtually its entire contents. The weight may comprise any suitable metal, such as stainless steel, and in the embodiment illustrated, the weight comprises a cylindrical jacket which is crimped on to the flexible tube with the bottom of the weight being open to allow for free flow of liquid 17 in to tube 12. The bottom portion of the weight has been beveled to allow it to move easily to fit into the comer of the container to aid in completely emptying the contents during dispensing.

The structure illustrated in FIG. 1 shows the use of the present invention which comprises an adapter and connected elongated tube affixed in place on a bottle 16 which typically depicts a carbonated beverage bottle. The purpose of the device in use is to preserve indefinitely the carbonated beverage effervescence and flavor by s eating carbonated beverage container upon initially opening the container, and keeping the adapter in sealed engagement until the contents of the bottle are entirely used up.

As can be seen from FIG. 1, the adapter 10 provides for a low profile which does not increase the overall height of the beverage bottle to any great extent and therefore allows for ease of storage in a refrigerator. Typically the adapter adds ⅝" or less to the height of the bottle. This feature is due to the novel and simple design of the plunger and valving mechanism of the device of the present invention which will be discussed in greater detail hereinafter.

Figure 2:
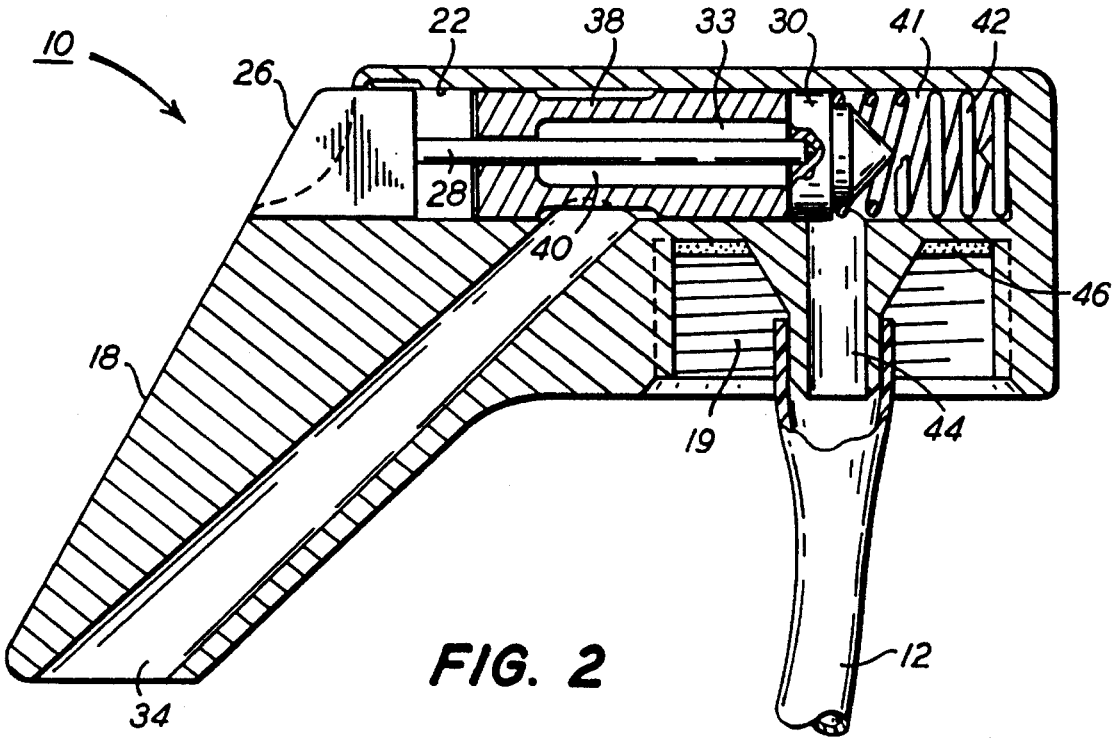
FIG. 2 is a vertical cross sectional view of one embodiment of the present invention in which the valve mechanism is in the closed position.
Figure 3:
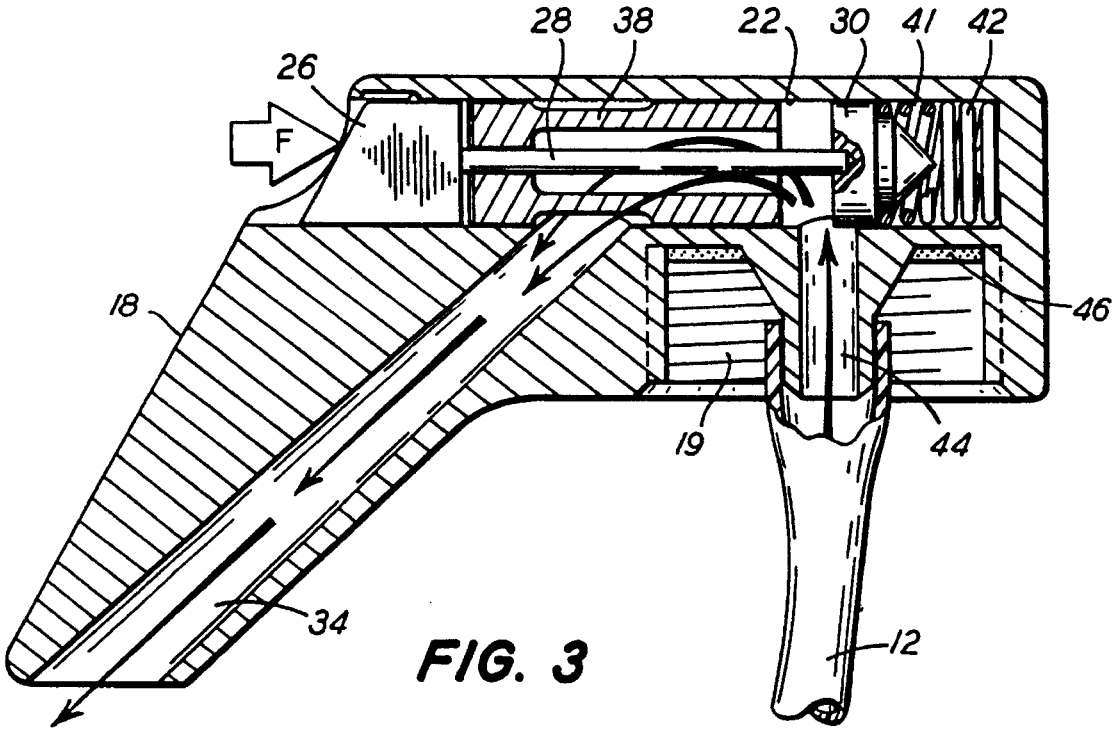
FIG. 3 is a vertical cross sectional view of the device of FIG. 2 in which the plunger mechanism is in the open position.

A preferred embodiment of the present invention is illustrated in FIG. 2 in which the adapter 10 comprises an outer housing 18 which contains a horizontal internal bore 22 which receives and accommodates a valve assembly 20, which comprises a plunger 24, having a plunger head 26 connected integrally with a plunger shaft 28 which is connected at its opposite end to a valve head 30. Mounted on shaft 28 intermediate the plunger head 26 and valve head 30 is a fixed hollow cylindrical valve seat body 32 which contains a rear seal 34 at one end and a fixed front seal 36. The two seals function to prevent any fluid flow in the areas defined by the seal. Intermediate the two seals are four fluted members 38 which connect seals 34 and 36 and which define four open areas 40. The housing 18 further contains a vertical channel 44 at the valve head end of bore 22. The lower end of channel 44 is connected to flexible tube 12 and the upper end connected to the bore 22 which contains the valve assembly 20 in the normally closed or locked position illustrated in FIG. 2. A tapered spout 34 is connected to internal bore 22 to form a flow path when the valve assembly is in the open position. The plunger mechanism with valve head 30 is normally maintained in a stational position against a stainless steel spring 42. As can be seen in FIG. 2, the valve head 30 defines a chamber 41 at the end of bore 22 which contains the spring. In this position, the valve head acts to effective close the liquid flow by sealing the top of channel 44 with pressurized liquid 17 being contained in chamber 41. The lower end of the adapter in operation is threaded in sealed engagement with the top of the container bottle through seal 46. When pressure is placed against plunger head 26 as illustrated in FIG. 3 by the arrow, the movable valve head 30, connected to plunger shaft 28, moves to the right to compress spring 42 resulting in the plunger head passing the open top orifice of channel 44 and allowing a fluid flow from pressure contained within the bottle to flow into and through the hollow central portion 33 of valve assembly seat body 32 passing through open spaces 40 and out through tapered spout 34. The arrows in the drawings depict the path of the fluid flow. The spout 34 is tapered in order to avoid undesirable dripping of fluid or liquid from the valve assembly :when the valve is moved from the open to the closed position.

If the internal diameter of the spout is not tapered outwardly from internal bore 22, the vacuum and surface tension created by the weight of the fluid temporarily held in place in the valve assembly and along the internal walls of the spout upon closing the valve, causes an undesirable dripping of fluid. It was discovered that the outward taper eliminates this dripping problem.

The adapter housing and other components may be made of any suitable plastic. A suitable hard plastic which may be used is PVC. The valve head and seals are normally made of any suitable soft plastic.

Figure 4:
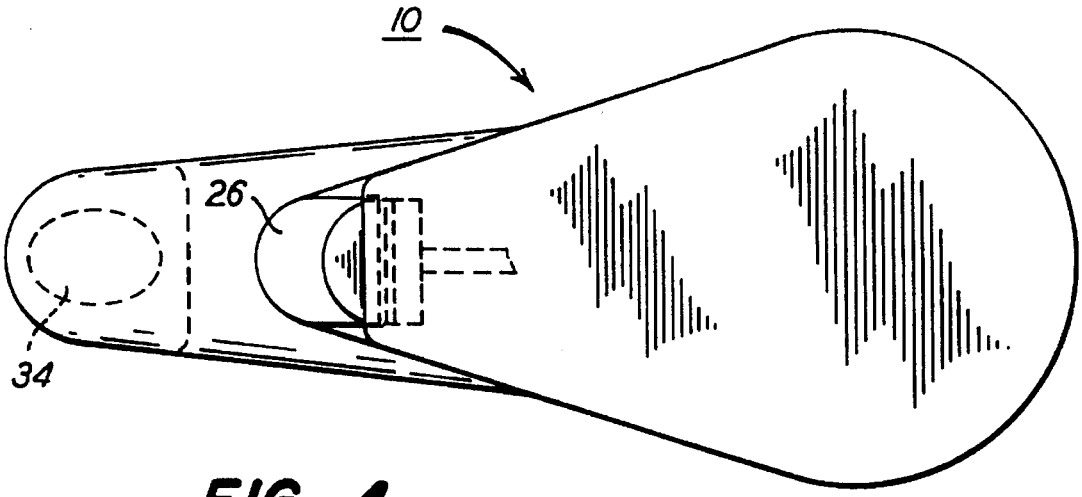
FIG. 4 is a top view of the device of FIG. 2.

FIG. 4 illustrates a top view of the adapter.

Figure 5:
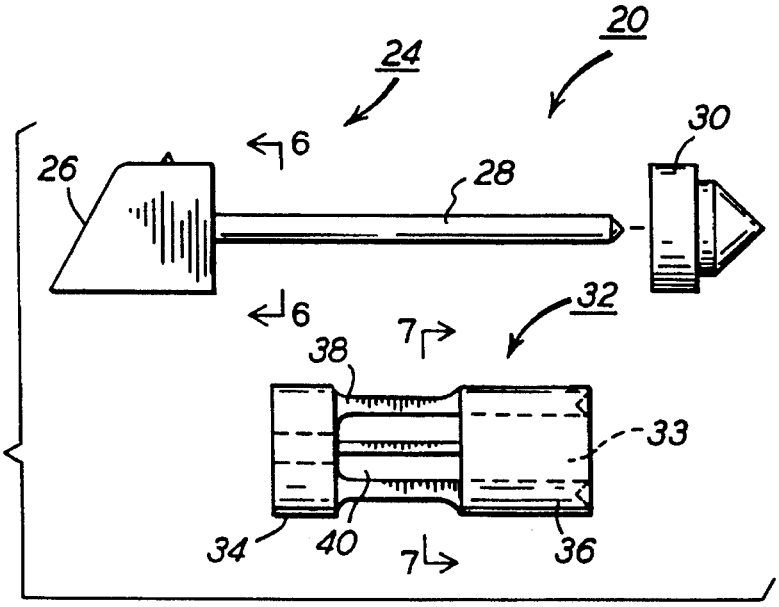
FIG. 5 is an exploded view of the valve assembly mechanism illustrated in the device of FIG. 2.

FIG. 5 illustrates an exploded view of the valve assembly 20 with each of the basic parts broken away in order to show greater detail.

Figure 6:
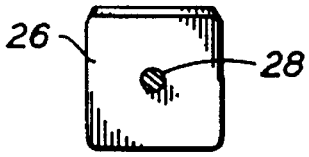
FIG. 6 is a view taken at 6—6 of FIG. 5.
Figure 7:
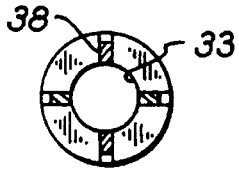
FIG. 7 is a view taken at 7—7 of FIG. 5.

FIGS. 6 and 7 respectively show sectional views along lines 6—6 and fines 7—7 of FIG. 5.

Figure 8:
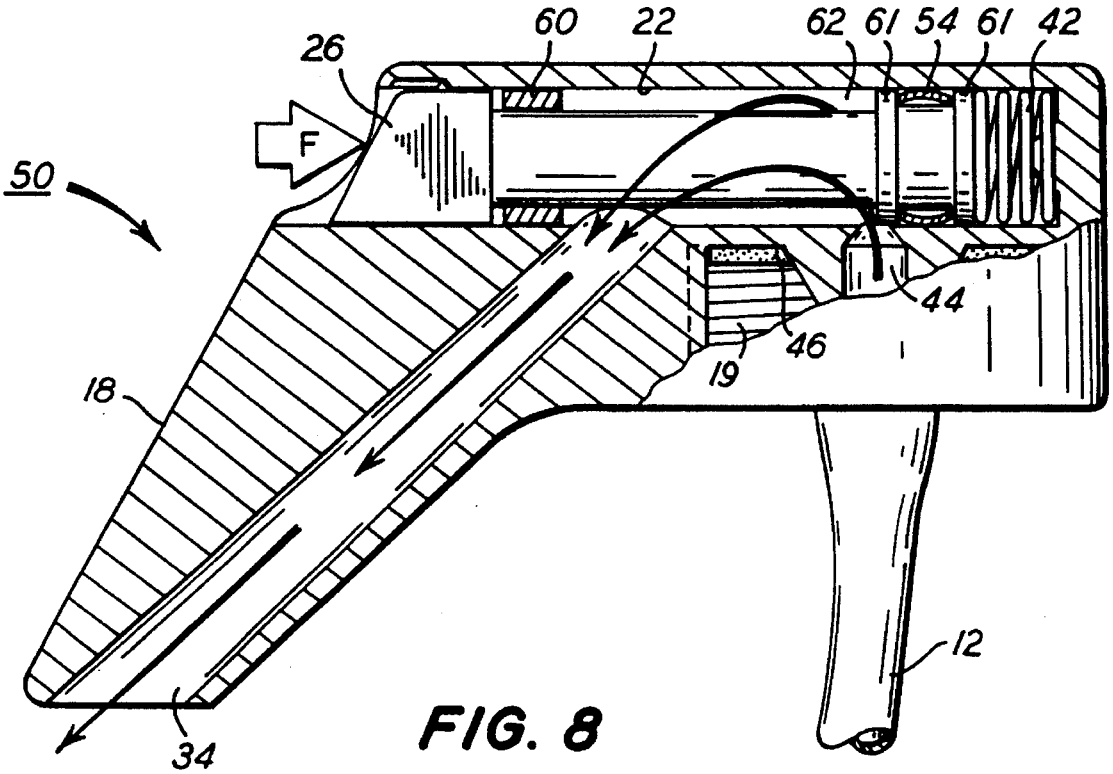
FIG. 8 is a vertical cross sectional view of a second embodiment of a device of the present invention with the valve in the open position.

FIG. 8 illustrates a second embodiment of the present invention in which an adapter 50 contains an alternative valve assembly 52. In this embodiment the valve utilizes a sealing ring 54 which operates to effectively to seal the top orifice of channel 44 when in the closed or locked position. In FIG. 8, the device is illustrated in the open position, where the valve assembly 52 comprises a plunger head 26 connected to valve head 56 by shaft 58. The valve head 56 contains two cylindrical flanges 61 which define an intermediate space of reduced diameter 59 which is sized to accommodate sealing ring 54 in a convex configuration for sealing the top opening of channel 44. The opposite end of bore 22 is closed to fluid flow by seal 60. Connecting shaft 58 has a diameter that it is reduced in size to less than the internal diamcter of bore 22 to allow for a flow fluid from the inside of the container 16 through tube 12 up through channel 44 and into the annulus or space 62 between bore 22 and shaft 58 and out tapered spout 34. The arrows in the drawing depict the path of the fluid flow.

Figure 9:
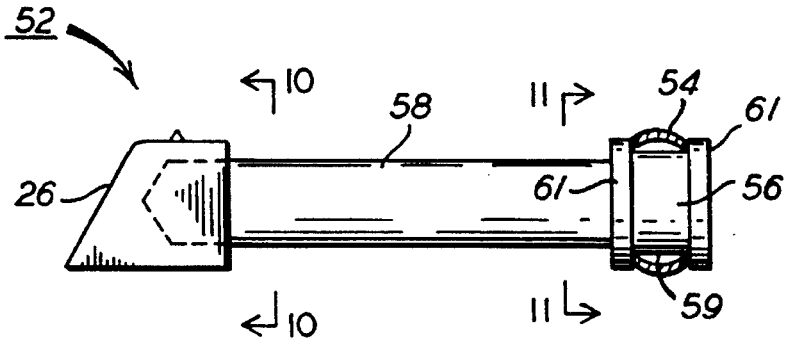
FIG. 9 is an exploded view of the valve assembly shown in the device of FIG. 8.
Figure 10:
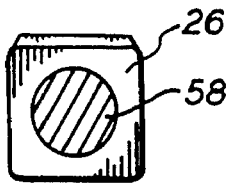
FIG. 10 is a view taken at 10—10 of FIG. 9.
Figure 11:
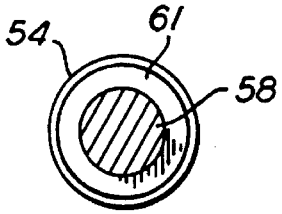
FIG. 11 is a view taken at 11—11 of FIG. 9.

An exploded view of the valve assembly for this device is shown in FIG. 9 with sectional views shown in FIGS. 10 and 11, respectively.

While the invention has been described in detail with respect to specific embodiments thereof, it will be understood by those skilled in the art that variations and modifications may be made without departing from the essential features thereof.

What is claimed:

1. A sealing and dispensing device for controllably dispensing pressurized liquid from a container having a discharge opening located above the surface of the liquid contained within the container comprising when the container is oriented with the discharge opening on top;

(a) an adapter for matingly sealably connecting with the discharge opening of the container, said adapter further including a central opening in the form of an elongated channel that is oriented perpendicular to the discharge opening;

(b) a flexible elongated tube sealably connected to said central opening of said adapter with the unconnected lower end of said tube being weighted to insure that it remains immersed within the liquid held in said container; and (c) a dispensing valve housing formed integral with the top of said adapter and surrounding said central opening, said housing having a valve chamber which contains a channel, said channel having a horizontally operable valve plunger operably located within said channel for reciprocal movement in the elongated channel, perpendicular to the discharge opening, with said plunger operating from a normally closed position in which said central opening and said plunger are in sealed engagement, to an open position where said plunger and said central opening define an open flow path to allow the flow of liquid under pressure from said container through said flexible elongated tube, through said central opening, past said plunger and to discharge through a dispensing spout connected to said adapter, the dispensing spout located between the elongated channel when the container is oriented with the discharge opening on top.

2. The device of claim 1 in which the length of the tube is sufficiently long to allow it to be used for a wide range of container sizes.

3. The device of claim 1 in which the valve in the closed position is accomplished by the sealing effect of a valve seat body and a valve head which in combination seal the central opening and prevent the flow of liquid from the container.

4. The device of claim 1 in which the central opening is open and closed by a resilient sealing ring which is held in fixed engagement at the end of the plunger.

5. The device of claim 1 in which the internal bore of the dispensing spout is tapered.

6. The device of claim 5 in which the spout has an outward taper.

7. The device of claim 1 in which the adapter has a low profile in order to avoid increasing the height of the container.

8. A sealing and dispensing device for controllably dispensing pressurized liquid from a container having a discharge opening located above the surface of the liquid contained within the container comprising:

(a) an adapter for matingly sealably connecting with the discharge opening of the container, said adapter further including a central opening in the form of an elongated channel;

(b) a flexible elongated tube sealably connected to said central opening of said adapter with the unconnected lower end of said tube being weighted to insure that it remains immersed within the liquid held in said container; and (c) a dispensing valve housing formed integral with the top of said adapter and surrounding said central opening, said housing having a valve chamber which contains an elongated channel having a port formed in a side wall of the channel in fluid communication with the central opening, a valve plunger having a valve head on its distal end operably located within said channel, with said plunger operating from a normally closed position in which said valve head seals the valve port, to an open position where said valve head and defines an open flow path to allow the flow of liquid under pressure from said container through said flexible elongated tube, through said central opening, through the valve port past said valve head and to discharge through an outwardly tapered dispensing spout connected to said adapter.

9. A sealing and dispensing device for controllably dispensing pressurized liquid from a container having a discharge opening located above the surface of the liquid contained within the container comprising:

(a) an adapter for matingly sealably connecting with the discharge opening of the container, said adapter further including a central opening in the form of an elongated channel;

(b) a flexible elongated tube sealably connected to said central opening of said adapter with the unconnected lower end of said tube being weighted to insure that it remains immersed within the liquid held in said container; and (c) a dispensing valve housing formed integral with the top of said adapter and surrounding said central opening, said housing having a valve chamber which contains a channel, a valve port in a side wall of the channel, said channel having a valve plunger having first and second spaced apart cylindrical flanges defining an intermediate space therebetween; a resilient sealing member within the intermediate space, with said plunger operating from a normally closed position in which said sealing member and the valve port are in sealed engagement, to an open position where said sealing member and said valve port define an open flow path to allow the flow of liquid under pressure from said container through said flexible elongated tube, through said central opening, past said sealing member and to discharge through an outwardly tapered dispensing spout connected to said adapter.

* * * * *